US006821941B2

(12) United States Patent
Srinivas et al.

(10) Patent No.: US 6,821,941 B2
(45) Date of Patent: Nov. 23, 2004

(54) TABLET OF COMPACTED PARTICULATED CLEANING COMPOSITION

(75) Inventors: Bala Srinivas, Hasbrouck Heights, NJ (US); Purvita Shah, Jersey City, NJ (US)

(73) Assignee: ISP Investments Inc., Wilmington, DE (US)

( * ) Notice: Subject to any disclaimer, the term of this patent is extended or adjusted under 35 U.S.C. 154(b) by 45 days.

(21) Appl. No.: 10/293,082

(22) Filed: Nov. 13, 2002

(65) Prior Publication Data

US 2004/0082493 A1 Apr. 29, 2004

Related U.S. Application Data

(60) Provisional application No. 60/420,589, filed on Oct. 23, 2002.

(51) Int. Cl.[7] ..... C11D 17/00; C11D 3/37

(52) U.S. Cl. ..... 510/446; 510/224; 510/475

(58) Field of Search ..... 510/446, 224, 510/475

(56) References Cited

U.S. PATENT DOCUMENTS

| | | | | | |
|---|---|---|---|---|---|
| 5,260,567 | A | * | 11/1993 | Kuroda et al. | 250/227.19 |
| 6,025,315 | A | * | 2/2000 | Gorlin et al. | 510/224 |
| 6,162,777 | A | * | 12/2000 | Gorlin et al. | 510/224 |
| 6,191,089 | B1 | * | 2/2001 | Gorlin et al. | 510/224 |
| 6,329,334 | B1 | * | 12/2001 | Bertleff et al. | 510/445 |
| 6,387,861 | B1 | * | 5/2002 | Van Asperen et al. | 510/298 |
| 6,486,111 | B1 | * | 11/2002 | Zabarylo et al. | 510/314 |
| 6,586,386 | B2 | * | 7/2003 | Srinivas et al. | 510/446 |
| 6,596,682 | B1 | * | 7/2003 | Gorlin et al. | 510/440 |
| 2002/0160930 | A1 | * | 10/2002 | Emmerson et al. | 510/445 |

* cited by examiner

*Primary Examiner*—Lorna M. Douyon
(74) *Attorney, Agent, or Firm*—William J. Davis; Walter Katz

(57) ABSTRACT

A tablet of compacted particulate cleaning composition has about 0.5–10% by wt. of a composite disintegrant blend of, by weight, (a) about 20–80% of a water soluble salt, (b) about 80–20% of crosslinked polyvinylpyrrolidone (PVPP), the tablet having a disintegration rate of at least 40 g/min.

6 Claims, 1 Drawing Sheet

Disintegrant Performance Requirement (40 gm/ min)

TABLET OF COMPACTED PARTICULATED CLEANING COMPOSITION

CROSS REFERENCE TO RELATED APPLICATIONS

Figure 1:
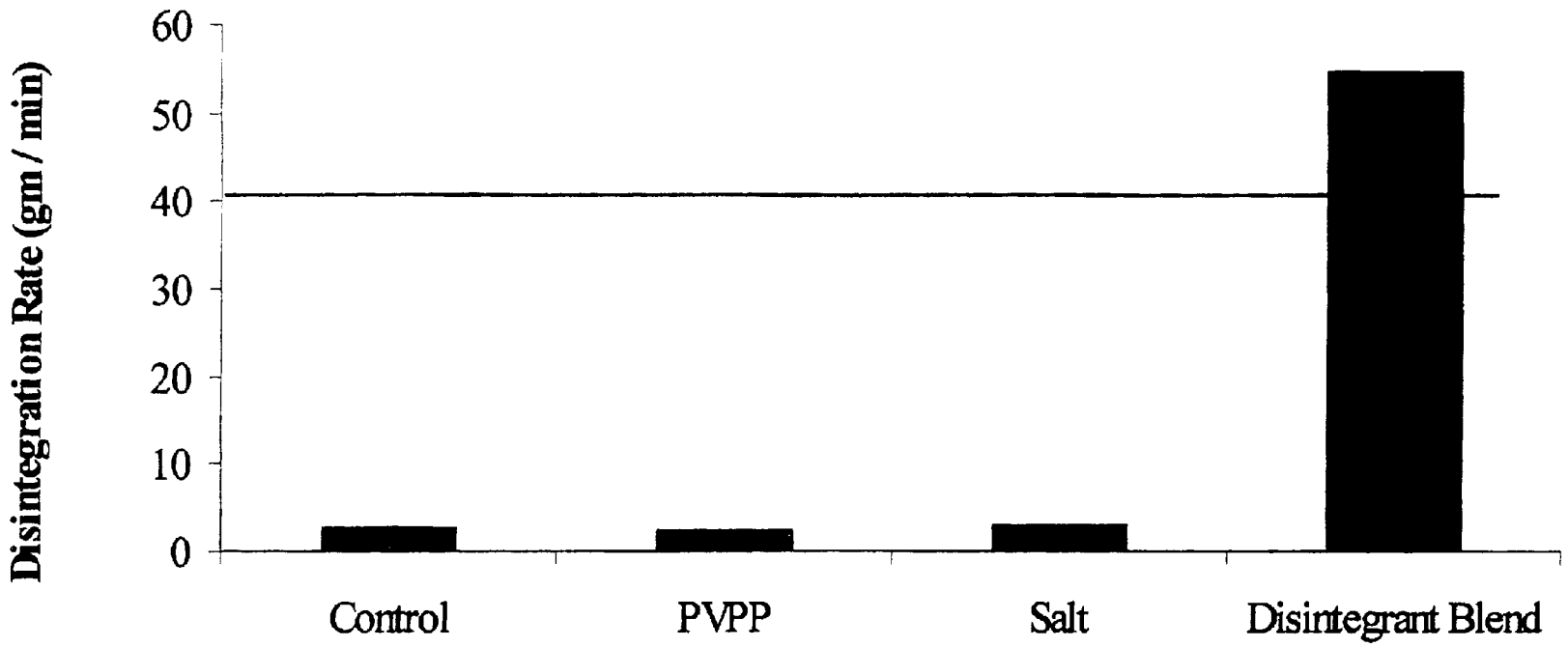

This application claims the benefit of U.S. Provisional Patent Application Ser. No. 60/420,589, filed on Oct. 23, 2002, the complete disclosure of which is hereby incorporated by reference.

BACKGROUND OF THE INVENTION

1. Field of the Invention

This invention relates to detergent compositions in the form of tablets, particularly for use in dishwashing, laundry washing and water softening and use applications thereof, and, more particularly, to a composite disintegration blend of defined amounts of a water-soluble salt, and crosslinked polyvinylpyrrolidone, having a disintegration rate of at least 40 g/min.

2. Description of the Prior Art

Tablets have the advantage that they do not require the user to measure out a volume of powder or liquid. Instead, one or several tablets provide an appropriate quantity of composition for washing a single load in, for example, a dishwashing machine. Tablets thus are easier for the consumer to handle and dispense.

Detergent compositions in tablet form have been described in a number of documents and are sold commercially.

Such tablets generally are made by compressing or compacting a quantity of detergent composition in particulate form. It is desirable that tablets should have adequate mechanical strength when dry before use, yet disintegrate and disperse/dissolve quickly when added to wash water. However, it is often difficult to achieve both properties simultaneously. As more pressure is applied when a tablet is compacted, the tablet density and strength rises (a hard tablet), but there is also a reduction in the speed of disintegration/dissolution when the tablet comes into contact with wash water at the time of use. Organic detergent serves as a binder, but a typical quantity of such detergent can also retard disintegration and dissolution of a tablet.

The prior art has described the numerous difficulties in providing suitable tablets of detergent compositions, including EPA 466485; WO 00/32741; EPA 711827; EPA 838519; WO 99/36493; WO 98/55583; GB 911204; U.S. Pat. No. 3,953,350; JP 60-015500A; EP-A-711827; WO 96/28530; EP 1070741; and EP 1036839.

IN THE DRAWING

The FIGURE is a bar graph of Disintegration Rate (g/min) vs. Additive Ingredient present in a standard dishwashing detergent formulation.

SUMMARY OF THE INVENTION

What is described herein is a tablet of compacted particulate cleaning composition, wherein the tablet or a discrete region thereof contains surfactant and detergency builder, characterized by containing about 1–10% by wt. of a composite disintegrant blend comprising, by weight, (a) about 20–80% of a water soluble salt, (b) about 80–20% of crosslinked polyvinylpyrrolidone, said tablet having a disintegration rate of at least 40 g/min.

Preferably, in this invention, (a) is 40–60% of a water soluble salt; preferably urea; (b) is 40–60% crosslinked polyvinylpyrrolidone.

Suitably, (a) has an average particle size of about 25–350 microns; and (b) has an average particle size of about 50–350 microns.

DETAILED DESCRIPTION OF THE INVENTION

Constituent materials for detergent tablets will now be discussed in more detail, and various optional and preferred features will be mentioned.

Nonionic Detergent Particles

As mentioned above, tablets of this invention will preferably include a nonionic detergent. Although some nonionic detergent may be included with the anionic detergent in the particles discussed above, we prefer to incorporate nonionic detergent as separate particles. Such nonionic detergent particles preferably comprise at least 20% of their own weight of nonionic detergent.

Such nonionic detergent particles preferably contain less than 10% by weight of anionic detergent, and preferably substantially no anionic detergent.

Nonionic detergent compounds include in particular the products obtainable by reaction of alkylene oxides, especially ethylene oxide with compounds having a hydrophobic group and a reactive hydrogen atom, for example, aliphatic alcohols, acids, amides or alkyl phenols.

Non-ethoxylated nonionic detergents include alkyl polyglycosides, glycerol monoethers, and polyhydroxy amides (glucamide).

Specific nonionic detergent compounds are alkyl ($C_{8-22}$) phenolethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine.

Especially referred are the primary and secondary alcohol ethoxylates, especially the $C_{9-11}$ and $C_{12-15}$ primary and secondary alcohols ethoxylated with an average of from 3 to 20 moles of ethylene oxide per mole of alcohol.

Nonionic detergent particles suitable for use in the present invention generally fall into one of two classes.

The first class comprises nonionic detergent carried on water-soluble carrier material. Suitable carrier materials include burkeite, sodium sesquicarbonate, sodium carbonate, sodium sulphate and mixtures thereof. A nonionic detergent particle comprising water-soluble carrier preferably comprises from 20 to 50% by weight, preferably from 25 to 40% by weight, of nonionic detergent.

The water-soluble carrier material is preferably present at a level exceeding 40% by weight, preferably 60% by weight or more.

The second class of nonionic detergent particle comprises water-insoluble carrier material. The insoluble carrier material may comprise silica or aluminosilicate, such as zeolite. However, it is preferred that, if aluminosilicate is present, the quantity is less than 10% by weight. Where an insoluble carrier material is used, the quantity of nonionic detergent may exceed 50% by weight of the particle, e.g. 52% or above.

Particles containing nonionic detergent absorbed on a solid carrier material can be made by spraying the nonionic detergent onto the carrier material in a granulator or some other type of mixing apparatus.

Other materials, serving to improve the physical properties of the particles, may also be included. Such materials are frequently referred to as "structuring agents". Examples are polyethylene/polypropylene glycol of average molecular weight in the region 4,000–12,000, sodium soap, polyvinyl alcohol of average molecular weight in the range 30,000–200,000, alkaline metal succinate etc. may be present. The preferred quantity of structuring agent is in the region from 0.5 to 20% by weight. Structuring agent may be added with other ingredients or during a second granulation step. Preferred particles may contain at least 35% (of their own weight) of nonionic detergent, preferably from 40 to 55% by weight of nonionic detergent. A preferred carrier is silica having an oil absorption capacity of at least 1.0 ml/g. Oil absorption capacity is a parameter which is well known and can be measured by the technique described in DIN ISO 787/5. Preferably, the oil absorption capacity is at least 1.5 ml/g, more preferably at least 2.0 ml/g.

Preferably, there is at least 10%, more preferably at least 15% of such silica in the particles, and the quantity of silica in the particles is greater than the quantity if any, of aluminosilicate. The particles may contain less than 10% of their own weight of aluminosilicate.

Nonionic detergent particles can be manufactured by one or two step processes of mixing together components in a granulator (for example an Eirich RV02 granulator, or equipment such as the Fukae mixer from Fukae Powtech Co. of Japan, the Diosna V-series supplied by Dierks & Sohne Germany, the Pharma Matrix ex TH Fielder Ltd England, the Lodige CB series and the Drais T160 series fro Drais Werke, GmbH, Mannheim, Germany).

Nonionic detergent particles preferably have mean particle size in a range from 200 to 2,000 $\mu$m such that at least 80% of these particles have a particle size in the range from 180 to 2,000 $\mu$m. All or at least a high proportion, at least 50% or 80%, of the nonionic detergent present in the tablet or region thereof may be provided by the nonionic detergent particles defined above. Alternatively, the nonionic detergent particles defined above may only provide between 10 and 50% of the total nonionic detergent content of the tablet or region thereof and thus act as a supplement to another source of nonionic detergent, such as a base powder.

Nonionic detergent particles may provide from 2 or 3 to 30% of a tablet or a region of a tablet. Such particles may constitute from 8 to 20% of a tablet, more especially if these particles contain at least 40% of nonionic detergent. Their amount may be not over 8 to 10% of the weight o the tablet or region, especially if the nonionic detergent particles are not the only source of nonionic detergent in the tablet or region thereof.

Other classes of organic detergent, such as amphoteric detergent, may be included but are not preferred. It is desirable that all or substantially all e.g. at least 90% by weight of all non-soap organic detergent is contained in the said particles (A) which contain anionic detergent or in other particles which contain at least 20% of their own weight of non-anionic, non-soap organic detergent.

Detergency Builder

A composition which is compacted to form some regions of tablets will contain from 5 to 80%, more usually 15 to 60% by weight of detergency builder. This may be provided wholly by water soluble materials, or may be provided in large part or even entirely by water-insoluble material with water-softening properties. Water-insoluble detergency builder may be present as 5 to 80 wt. %, better 5 to 60 wt. % of the composition.

Alkali metal aluminosilicates are strongly favored as environmentally acceptable water-insoluble builders for fabric washing. Alkali metal (preferably sodium) aluminosilicates may be either crystalline or amorphous or mixtures thereof, having the general formula:

$$0.8\text{–}1.5\ Na_2O.Al_2O_3.0.8\text{–}6\ SiO_2.\ xH_2O$$

These materials contain some bound water (indicated as "xH20") and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1429143 (Procter & Gamble). The preferred sidium aluminosilicates of this type are the well known commercially available zeolites A and X, the novel zeolite P described and claimed in EP 384070 (Unilever) and mixtures thereof.

Conceivably a water-insoluble detergency builder could be a layered sodium silicate as described in U.S. Pat. No. 4,664,839. NaSKS-6 is the trademark for a crystalline layered silicate marketed by Hoechst (commonly abbreviated as "SKS-6"). NaSKS-6 has the delta-$Na_2SiO_5$ morphology form of layered silicate. It can be prepared by methods such as described in DE-A-3,417,649 and DE-A-3,742,043. Other such layered silicates, such as those having the general formula $NaMSI_xO_{2x+1}.yH_2O$ wherein M is sodium or hydrogen, x is a number from 1.9 to 4, preferably 2, and y is a number from 0 to 20, preferably 0 can be used.

Water-soluble phosphorous-containing inorganic detergency builders, include the alkali-metal orthophosphates, metaphosphates, pyrophosphates and polyphosphates. Specific examples of inorganic phosphate builders include sodium and potassium tripolyphosphates, orthophosphates and hexametaphosphates.

Non-phosphorous water-soluble builders may be organic or inorganic. Inorganic builders that may be present include alkali metal (generally sodium) carbonate; while organic builders include polycarboxylate polymers, such as polyacrylates, acrylic/maleic copolymers, and acrylic phosphonates, monomeric polycarboxylates such as citrates, gluconates, oxydisuccinates, glycerol mono-, di- and trisuccinates, carboxymethyloxysuccinates, carboxymethyloxymalonates, dipicolinates and hydroxyethyliminodiacetates.

At least one region of a dishwashing tablet preferably include polycarboxylate polymers, more especially polyacrylates and acrylic/maleic copolymers which can function as builders and also inhibit unwanted deposition onto fabric from the wash liquor.

Bleach System

Tablets according to the invention may contain a bleach system in at least one region of a tablet. This preferably comprises one or more peroxy bleach compounds, for example, inorganic persalts or organic peroxyacids, which may be employed in conjunction with activators to improve bleaching action at low wash temperatures. If any peroxygen compound is present, the amount is likely to lie in a range from 10 to 25% by weight of the composition.

Preferred inorganic persalts are sodium perborate monohydrate and tetrahydrate, and sodium percarbonate, advantageously employed together with an activator. Bleach activators, also referred to as bleach precursors, have been widely disclosed in the art. Preferred examples include peracetic acid precursors, for example, tetraacetylethylene diamine (TAED), now in widespread commercial use in conjunction with sodium perborate; and perbenzoic acid precursors. The quaternary ammonium and phosphonium bleach activators disclosed in U.S. Pat. No. 4,751,015 and U.S. Pat. No. 4,818,426 (Lever Brothers Company) are also of interest. Another type of bleach activator which may be used, but which is not a bleach precursor, is a transition metal catalyst as disclosed in EP-A-458397, EP-A-458398 and EP-A-549272. A bleach system may also include a bleach stabilizer (heavy metal sequestrant) such as ethylenediamine tetramethylene phosphonate and diethylenetriamine pentamethylene phosphonate.

As indicated above, if a bleach is present and is a water-soluble inorganic peroxygen bleach, the amount may well be from 10% to 25% by weight of the composition.

Other Detergent Ingredients

The detergent tablets of the invention may also contain one of the detergency enzymes well known in the art for their ability to degrade and aid in the removal of various soils and stains. Suitable enzymes include the various proteases, cellulases, lipases, amylases, and mixtures thereof, which are designed to remove a variety of soils and stains from fabrics. Examples of suitable proteases are Maxatase™, as supplied by Gist-Brocades N.V., Delft, Holland, and Alcalase™, and Savinase™, as supplied by Novo Industri A/S, Copenhagen, Denmark. Detergency enzymes are commonly employed in the form of granules or marumes, optionally with a protective coating, in amount of from about 0.1% to about 3.0% by weight of the composition; and these granules or marumes present no problems with respect to compaction to form a tablet.

The detergent tablets of the invention may also contain a fluorescer (optical brightener), for example, Tinopal™ DMS or Tinopal CBS available from Ciba-Geigy AG, Basel, Switzerland. Tinopal DMS is disodium 4,4'bis-(2-morpholino-4-anilino-s-triazin-6-ylamino) stilbene disulphonate; and Tinopal CBS is disodium 2,2'-bis-(phenylstyryl) disulphonate.

An antifoam material is advantageously included, especially if a detergent tablet is primarily intended for use in front-loading drum-type automatic washing machines. Suitable antifoam materials are usually in granular form, such as those described in EP 266863A (Unilever). Such antifoam granules typically comprise a mixture of silicone oil, petroleum jelly, hydrophobic silica and alkyl phosphate as antifoam active material, absorbed onto a porous absorbed water-soluble carbonate-based inorganic carrier material. Antifoam granules may be present in an amount up to 5% by weight of the composition.

It may also be desirable that a detergent tablet of the invention includes an amount of an alkali metal silicate, particularly sodium ortho-, meta- or disilicate. The presence of such alkali metal silicates at levels, for example, of 0.1 to 10 wt. %, may be advantageous in providing protection against the corrosion of metal parts in washing machines, besides providing some measure of building and giving processing benefits in manufacture of the particulate material which is compacted into tablets.

A tablet for dishwashing will generally not contain more than 15 wt. % silicate. A tablet for machine dishwashing will often contain more than 20 wt. % silicate.

Further ingredients which can optionally be employed in a region of a fabric washing detergent tablet of the invention include anti-redeposition agents such as sodium carboxymethylcellulose, straight-chain polyvinyl pyrrolidone and the cellulose ethers such as methyl cellulose and ethyl hydroxyethyl cellulose, fabric-softening agents; heavy metal sequestrants such as EDTA; perfumes; and colorants or colored speckles.

Disintegration Enhancing Particles

In accordance with this invention, a constituent of the component blend of the tablet which serves to accelerate tablet disintegration in water is a water soluble material.

Accordingly, the first component of the composite disintegration aid is (a) a highly water-soluble material, especially salts in an amount of about 20–80% by weight of the composite, preferably 40–60%.

Suitably, the water soluble salt has a solubility at 20° C. of at least 50 g per 100 g of water. A solubility of at least 50 g per 100 g of water at 20° C. is an exceptionally high solubility: many materials which are classified as water soluble are less soluble than this.

Some highly water-soluble materials which may be used are listed below, with their solubilities expressed as grams of solid to form a saturated solution in 100 g of water at 20° C.

| Water-Soluble Material | Water Solubility (g/100 g) |
|---|---|
| Sodium citrate dihydrate | 72 |
| Potassium carbonate | 112 |
| Urea | >100 |
| Sodium acetate, anhydrous | 119 |
| Sodium acetate trihydrate | 76 |
| Magnesium sulphate $7H_2O$ | 71 |
| Potassium acetate | >200 |

Preferably, this highly water soluble material is incorporated as particles of the matrix in a substantially pure form, in an amount of 20–80%, preferably 40–60%, of the disintegrant blend. Urea is a preferred water-soluble material, most preferably as 60% of the blend, with an average particle size of about 25–350 microns.

The second component (b) of the disintegrant blend blend of the invention is present in an amount 80–20%, preferably 60–40%, and most preferably about 40% of the blend. The second component is crosslinked polyvinylpyrrolidone (PVPP). Suitably, (b) has an average particle size of about 50–350 microns.

Ideally both (a) and (b) have about the same particle size so that one component of the blend does not settle out of the powder composition before tableting. Also similar particle sizes of each and the rest of the cleaning composition will enable tablets of the composition to form more easily.

Composition of Disintegration Blend In Dishwasher Detergent Formulations

| | Wt. % | Range | Preferred |
|---|---|---|---|
| Standard Dishwasher Detergent* | 94 | 90–99.5 | 92–98 |
| Disintegrant Blend | 6 | 0.5–10 | 2–8 |
| (a) Urea (20–80%) | 3.6 | | |
| (b) + PVPP (80–20%) | 2.4 | | |

| Builder | Wt. % | Range |
|---|---|---|
| Sec.tripollyphosphate (STPP) | 40 | 30–70 |
| Sodium Carbonate | 32.75} | |
| Sodium Sulfate | 19.35} | 40–80 |
| Sodium Metasilicate (alkaline to $11^+$) | 6.45} | |
| Sodium Stearate (release agent formed) | 0.8 | 0–1% |
| Neodol R25-9-surfactant (non-ionic | 0.65 | 0–1% |
| | 100.00 | |

*Typical Composition of Dishwashing Detergent

The dishwashing disintegrant tablets of the invention herein have a disintegration rate of at least 40 g/min (based on a tablet of 20 g). The FIGURE is a bar graph which shows such advantageous results, in which the tablet formulation herein, referred to in the FIGURE as the "Distintegrant Blend" of the composition above has a disintegration rate of 55 g/min, whereas the control (without blend) is close to zero; and other additives such as PVPP or urea (salt) alone also have only minimal disintegration rates. These results demonstrate the unexpected and significantly advantageous benefits achieved by incorporating the additive blend of the invention into dishwashing detergent compositions, and of its practical and economic benefits for the consumer.

While the invention has been described with particular reference to certain embodiments thereof, it will be understood that changes and modifications may be made which are within the skill of the art. Accordingly, it is intended to be bound only by the following claims.

What is claimed is:

1. A tablet of compacted particulate cleaning composition, wherein the tablet or a discrete region thereof contains detergency builder, characterized by containing about 0.5–10% by wt. of a composite disintegrant blend comprising, by weight, (a) about 20–80% of urea as a water soluble salt, (b) about 80–20% of crosslinked polyvinylpyrrolidone (PVPP), said tablet having a disintegration rate of at least 40 g/min.

2. A tablet according to claim 1 wherein (a) has an average particle size of at about 25–350 microns.

3. A tablet according to claim 1 wherein (b) has an average particle size of about 50–350 microns.

4. A tablet according to claim 1 which is a dishwashing composition.

5. A tablet according to claim 1 wherein the cleaning composition contains one or more substances from the group of bleaching activators, enzymes, pH adjusting agents, fragrances, perfume carriers, fluorescence agents, dyes, foam inhibitors, silicone oils, antiredeposition agents, optical brighteners, graying inhibitors, color transfer inhibitors, and corrosion inhibitors.

6. A tablet according to claim 4 wherein the region containing detergency builder is about 92–98% of the composition and the disintegrant blend is about 2–8% of the composition.

* * * * *